US007992552B2

(12) United States Patent
Hirano et al.

(10) Patent No.: US 7,992,552 B2
(45) Date of Patent: Aug. 9, 2011

(54) COOKING DEVICE

(75) Inventors: Seiichi Hirano, Osaka (JP); Tatsuhiko Nakamura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 249 days.

(21) Appl. No.: 12/351,904

(22) Filed: Jan. 12, 2009

(65) Prior Publication Data

US 2009/0183724 A1 Jul. 23, 2009

(30) Foreign Application Priority Data

Jan. 22, 2008 (JP) ..... 2008-011990

(51) Int. Cl.
*F24C 15/32* (2006.01)

(52) U.S. Cl. ..... 126/21 A; 126/21 R; 126/80; 454/15; 454/186; 454/253; 417/423.15

(58) Field of Classification Search ..... 126/21 A, 126/21 R, 80; 417/423.15; 454/15, 186, 454/253

See application file for complete search history.

(56) References Cited

U.S. PATENT DOCUMENTS

| | | | | |
|---|---|---|---|---|
| 2,800,272 | A * | 7/1957 | McKee | 417/373 |
| 3,170,621 | A * | 2/1965 | Morrison | 417/368 |
| 3,264,506 | A * | 8/1966 | Sande al. | 310/216.132 |
| 3,327,610 | A * | 6/1967 | Cole | 126/299 D |
| 5,166,487 | A * | 11/1992 | Hurley et al. | 219/683 |
| 5,258,675 | A * | 11/1993 | Nelessen | 310/91 |
| 5,444,922 | A * | 8/1995 | Ubelhor | 34/210 |
| 6,259,063 | B1 * | 7/2001 | Lintner et al. | 219/399 |
| 6,509,556 | B2 * | 1/2003 | Kim | 219/757 |
| 6,972,398 | B2 * | 12/2005 | Kang | 219/757 |
| 2002/0084268 | A1 * | 7/2002 | Kim | 219/757 |
| 2005/0196306 | A1 * | 9/2005 | Del Zanno | 417/423.15 |

FOREIGN PATENT DOCUMENTS

| | | |
|---|---|---|
| CN | 1523284 A | 8/2004 |
| JP | 50-127004 | 10/1975 |
| JP | 06-185736 A | 7/1994 |
| JP | 2000-274693 | 10/2000 |

* cited by examiner

*Primary Examiner* — Kenneth B Rinehart
*Assistant Examiner* — Jorge Pereiro
(74) *Attorney, Agent, or Firm* — Birch, Stewart, Kolasch & Birch, LLP

(57) ABSTRACT

A cooking device body having a heating chamber for heating an object; a fan for discharging air in the heating chamber; and an exhaust duct for guiding air blown off from said fan to the outside of the cooking device body are provided, an opening is provided at a wall of said exhaust duct, and the fan is constructed to have a motor disposed outside the exhaust duct, a first plate which has a central side attached to the motor and an outer edge side attached to the periphery of the opening, a bladed wheel which is attached to the output shaft of the motor and disposed in the exhaust duct, and a second plate which defines a cavity between said bladed wheel and the first plate.

6 Claims, 14 Drawing Sheets

COOKING DEVICE

CROSS-REFERENCE TO RELATED APPLICATIONS

This Nonprovisional application claims priority under 35 U.S.C. §119(a) on Patent Application No. 2008-11990 filed in Japan on Jan. 22, 2008, the entire contents of which are hereby incorporated by reference.

BACKGROUND

1. Technical Field

The present invention relates to a cooking device such as a microwave oven for heating an object.

2. Description of Related Art

Cooking devices are divided into one for home use, which is located at a domestic kitchen to be used by family members, and one for business use, which is located at a kitchen in a hotel, a restaurant, a fast-food eatery or the like to be used by an employee or the like for serving a meal to a customer or the like. While one cooking device is located for home use since the cooking device is used only several times a day, generally a plurality of cooking devices are located for business use so as to immediately deal with demand for heat cooking since the cooking devices are used frequently during business hours. In this regard, the cooking devices are generally stacked in order to save limited space in a kitchen and to shorten a distance of horizontal motion which is an operation by a cooking employee and does not contribute directly to heat cooking.

Moreover, a cooking device comprises: a cooking device body having a heating chamber for heating an object and electromagnetic generating means for generating cooking heat in said heating chamber; an exhaust duct, which is disposed above the heating chamber, for discharging air in said heating chamber from an exhaust port to the outside; and a fan for supplying external air to the heating chamber, and is constructed in such a manner that air supplied to the heating chamber by driving the fan is distributed through the exhaust duct and discharged from the exhaust port to the outside (see Japanese Patent Application Laid-Open No. H6-185736 (1994), for example).

In a cooking device having such a structure, electromagnetic wave generated by the electromagnetic generating means is supplied to the heating chamber by electromagnetic supplying means so as to heat an object housed in the heating chamber, air supplied by driving the fan is supplied to the heating chamber, and air including hot air sometimes up to and rarely exceeding the boiling point and steam generated when the object is heated is distributed through the exhaust duct and discharged from the exhaust port to the outside. Accordingly, regarding a cooking device for business use to be used frequently during business hours, the amount of rise in temperature due to heat generation in a heating chamber and the amount of generation of steam are dramatically large and the cooking device is cooled and dried only on a nonbusiness day or, in all-night restaurant or the like, the cooking device can possibly keep operating from the point of installation to a kitchen for use to removal and disposal.

In view of even one cooking device, such a high operating ratio is expected to cause a problem. When cooking devices are stacked as described above, the amount of heat generation and the density of generated steam increase several times.

As described above, a cooking device for business use has a challenge different from that of a cooking device for home use having similar functions.

SUMMARY OF THE INVENTION

However, a cooking device has some small clearances, for example, between a heating chamber and a door for opening and closing the heating chamber, and at an attaching section where electromagnetic supplying means, a sensor for detecting the operation of said electromagnetic supplying means, or the like is attached. Accordingly, when a cooking device for business use to be used frequently during business hours is provided with a fan disposed at an air supply path for supplying air to a heating chamber as described in Japanese Patent Application Laid-Open No. H6-185736 (1994), it is highly possible that hot air and steam in the heating chamber blow off from the clearances to the outside and a remedy has been requested.

The present applicant has already developed a cooking device which is constructed by disposing a fan in an exhaust duct for discharging air in a heating chamber so as to suck air in the heating chamber into the exhaust duct and keep the heating chamber at a negative pressure, in order to prevent hot air and steam from blowing off from places other than an exhaust port to the outside.

However, in a cooking device for business use wherein a bladed wheel is located in an exhaust duct through which hot air and steam in a heating chamber is discharged and a motor for driving said bladed wheel is disposed outside the exhaust duct, thermal energy of hot air distributed in the exhaust duct is easily conducted from said bladed wheel to the motor and said motor tends to be overheated since the bladed wheel is made of metal in order to respond to a request for heat resistance.

Moreover, since an output shaft of the motor penetrates a wall plane of an exhaust duct with a void and exhaust blast increases the pressure of the inside of the exhaust duct to an ordinary pressure or a positive pressure, steam distributed in the exhaust duct easily flows along the output shaft of the motor and out to the motor side and condenses at the output shaft of the motor to be water droplets, and said water droplets enter a bearing with rotation of the output shaft to be mixed into lubricating oil and tend to lower lubricity.

Such a problem tends to cause lowering of electrical insulation or lowering of lubricity, which further causes the motor to stop, and a remedy has been requested.

Although a remedy of lengthening the output shaft of the motor has been discussed conventionally, there is a problem that lengthening of the output shaft of the motor tends to cause vibration and noise when dynamic balance of a bladed wheel lowers. Furthermore, a motor having a lengthened output shaft, which employs a custom-made specification other than a standard specification of a motor manufacturer, causes an increase in cost.

Moreover, although lowering of lubrication performance due to entering of steam or water droplets can be prevented when a ball bearing, which is sealed with heat-resistant grease filled therein, is used as a bearing of the output shaft, a motor having such a bearing structure, which employs a custom-made specification other than a standard specification of a motor manufacturer, causes an increase in cost.

In addition, although coating the winding of the motor with heat-resistant insulating material has been discussed, such a case, which employs a custom-made specification other than a standard specification of a motor manufacturer, also causes an increase in cost.

Cost reduction is one of major challenges of a cooking device for business use in addition to the reliability and performance, and development of a cooking device which resolves the above challenge related to the reliability while using a low-cost standard specification product mass-produced by a motor manufacturer has been requested.

The present invention has been made in view of such a situation, and the main object thereof is to provide a cooking device wherein an exhaust duct having an exhaust guide path for guiding air in a heating chamber blown off from a fan to the outside of a cooking device body is provided with an opening penetrating the exhaust guide path and the fan has a motor disposed outside the exhaust duct, a bladed wheel which is attached to an output shaft of said motor and disposed in the exhaust duct, a first plate having a central section attached to the motor and an outer edge section attached to the periphery of the opening, and a second plate having a shaft hole, into which the output shaft is to be inserted, provided at a central section and an outer edge section attached to a bladed wheel side of the first plate so as to provide a cavity at the periphery of the output shaft between the second plate and the first plate, so that conduction of hot air distributed in the exhaust duct and outflow of steam can be depressed by the cavity and the motor can be protected from hot air and steam.

A cooking device according to the present invention is a cooking device comprising a cooking device body having a heating chamber for heating an object, an exhaust duct communicating with a first port provided at a wall of the heating chamber and with the outside of the cooking device body, and a fan for discharging air in the heating chamber wherein said fan sucks air from the first port and air blown off from said fan is guided through the exhaust duct and exhausted out from the cooking device body, the exhaust duct has an opening at a wall in a direction intersecting a guiding direction, the fan includes a motor disposed outside the exhaust duct, a bladed wheel which is attached to the output shaft of said motor and disposed in the exhaust duct, a first plate, which is located between the motor and the bladed wheel, having a shaft hole into which the output shaft is inserted, and a second plate, which is located between said first plate and the bladed wheel, having a shaft hole into which the output shaft is inserted, and the opening of the exhaust duct is covered with one or both of the first plate and the second plate when the fan is attached to the exhaust duct.

In said invention, since conduction of hot air distributed in the exhaust duct to the motor side can be depressed by the second plate and outflow of steam distributed in the exhaust duct from the periphery of the output shaft to the motor side can be depressed by at least one of the first plate and the second plate to be used for covering the opening, it is possible to protect a motor from hot air and steam in the exhaust duct and to enhance the durability of the motor to hot air and steam in the exhaust duct.

Moreover, a cooking device according to the present invention is preferably constructed in such a manner that the periphery of the shaft hole of the first plate is attached to the motor, an outer edge section of the second plate is attached to the bladed wheel side of the first plate, and one or both of the first plate and the second plate are attached to the periphery of the opening of the exhaust duct from the outside of said exhaust duct, so that the fan is attached to the exhaust duct.

In said invention, since the motor, the first plate and the second plate can be modules and said modules can be attached to the periphery of the opening of the exhaust duct from the outside of said exhaust duct, it is possible to cover the opening by attaching the modules and to enhance the attachment workability of the motor including covering of the opening.

Moreover, a cooking device according to the present invention is preferably constructed in such a manner that the bladed wheel is formed so as to be inserted from the outside of the exhaust duct into the opening and the second plate has a recess depressed towards the bladed wheel side.

In said invention, since the motor, the bladed wheel, the first plate and the second plate can be modules and the opening of the exhaust duct is covered with one or both of the first plate and the second plate by inserting or detaching the bladed wheel of the modules into or from the opening of the exhaust duct, it is possible to enhance the attachment workability of the motor and the bladed wheel in the fan.

Moreover, since connection of the outer edge section of the second plate to the first plate can make the inside of the recess of said second plate a cavity, it is possible to form a cavity easily.

Moreover, a cooking device according to the present invention is preferably constructed in such a manner that a sealing tube is fitted into the shaft hole of the second plate.

In said invention, it is possible to prevent steam in the exhaust duct from outflowing to the motor side further reliably and to further enhance the durability of the motor to steam in the exhaust duct.

Moreover, a cooking device according to the present invention is preferably constructed in such a manner that a shaft hole section of the first plate has a recess depressed towards the motor side.

In said invention, since the inside of the recess of the first plate and the recess of the second plate can be a cavity, it is possible to increase the volume of the cavity, to further enhance the barrier properties by the cavity, to prevent hot air in the exhaust duct from entering the motor side further reliably, to prevent steam in the exhaust duct from outflowing to the motor side further reliably, and to further enhance the durability of the motor to hot air and steam in the exhaust duct by using a low-cost motor of a standard specification without using an expensive additional component.

With the present invention, since conduction of hot air, which is distributed in the exhaust duct, to the motor side can be depressed by the second plate and outflow of steam, which is distributed in the exhaust duct, from the periphery of the output shaft to the motor side can be depressed by at least one of the first plate and the second plate to be used for covering the opening, it is possible to protect a motor from hot air and steam in the exhaust duct and to enhance the durability of the motor to hot air and steam in the exhaust duct.

The above and further objects and features will more fully be apparent from the following detailed description with accompanying drawings.

DETAILED DESCRIPTION OF THE INVENTION

The following description will explain the present invention in detail with reference to the drawings illustrating an embodiment thereof.

Figure 1:
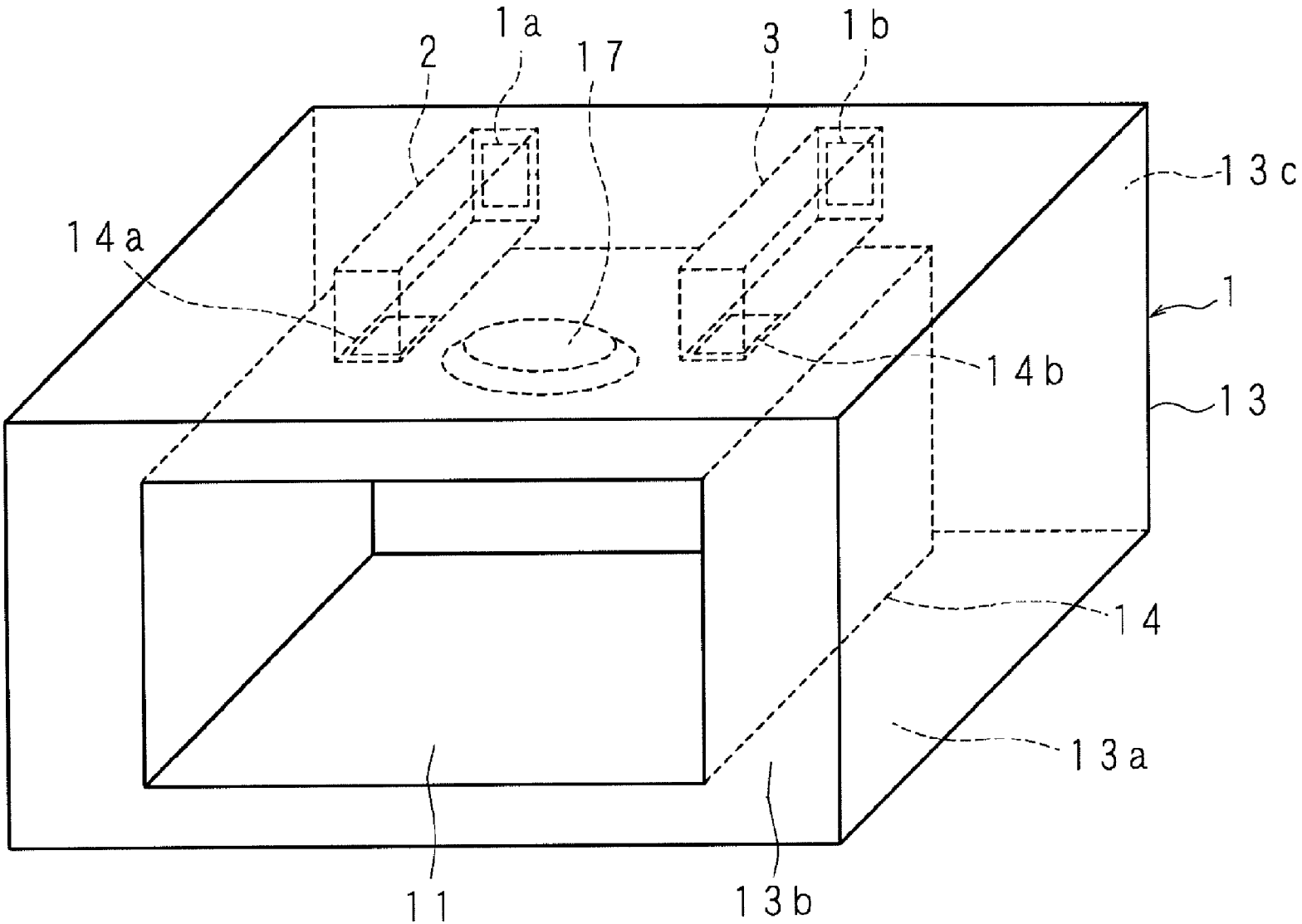
FIG. 1 is a schematic perspective view for showing the structure of a cooking device according to the present invention.
Figure 2:
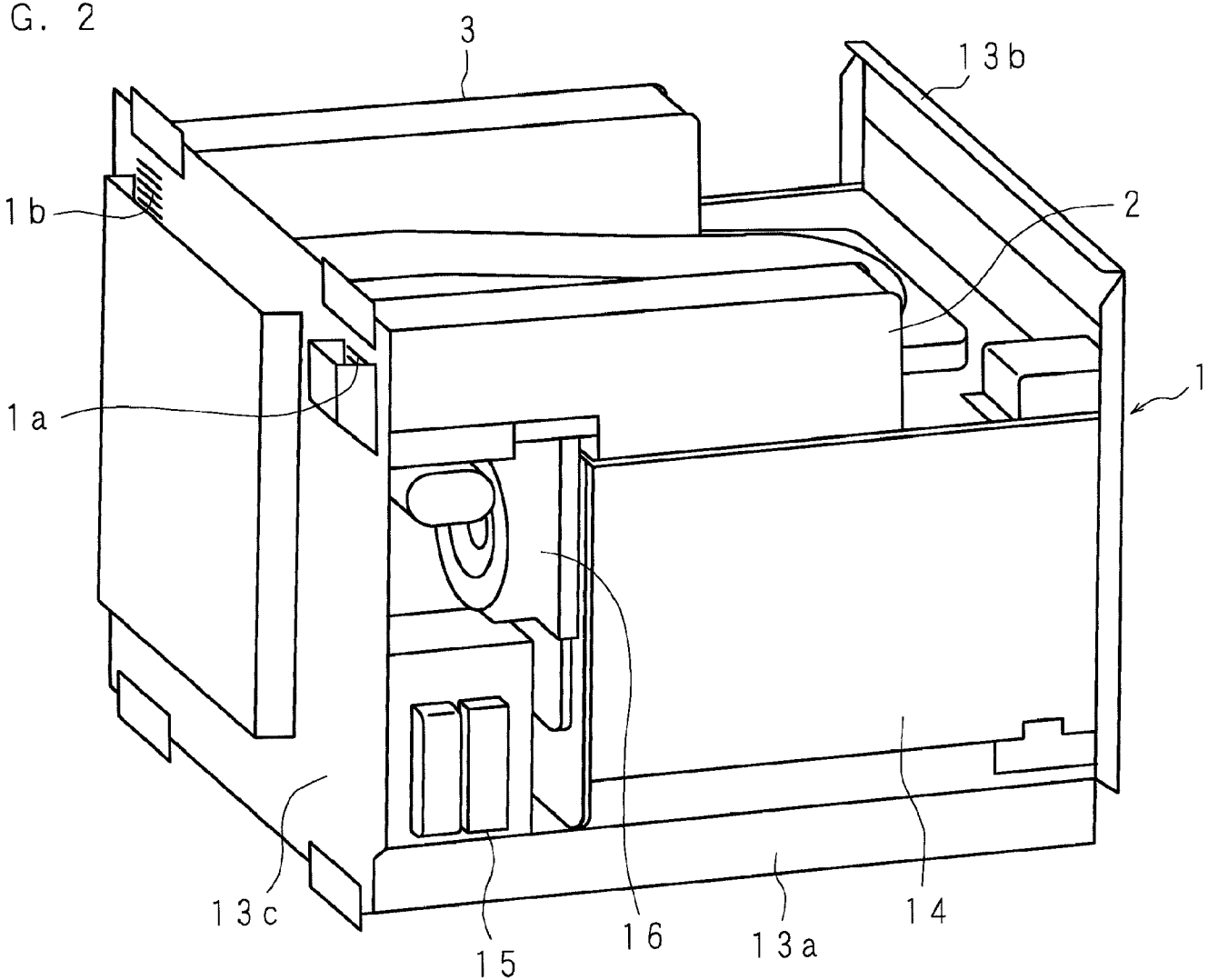
FIG. 2 is a partial rear-side perspective view for showing the structure of a cooking device according to the present invention.
Figure 3:
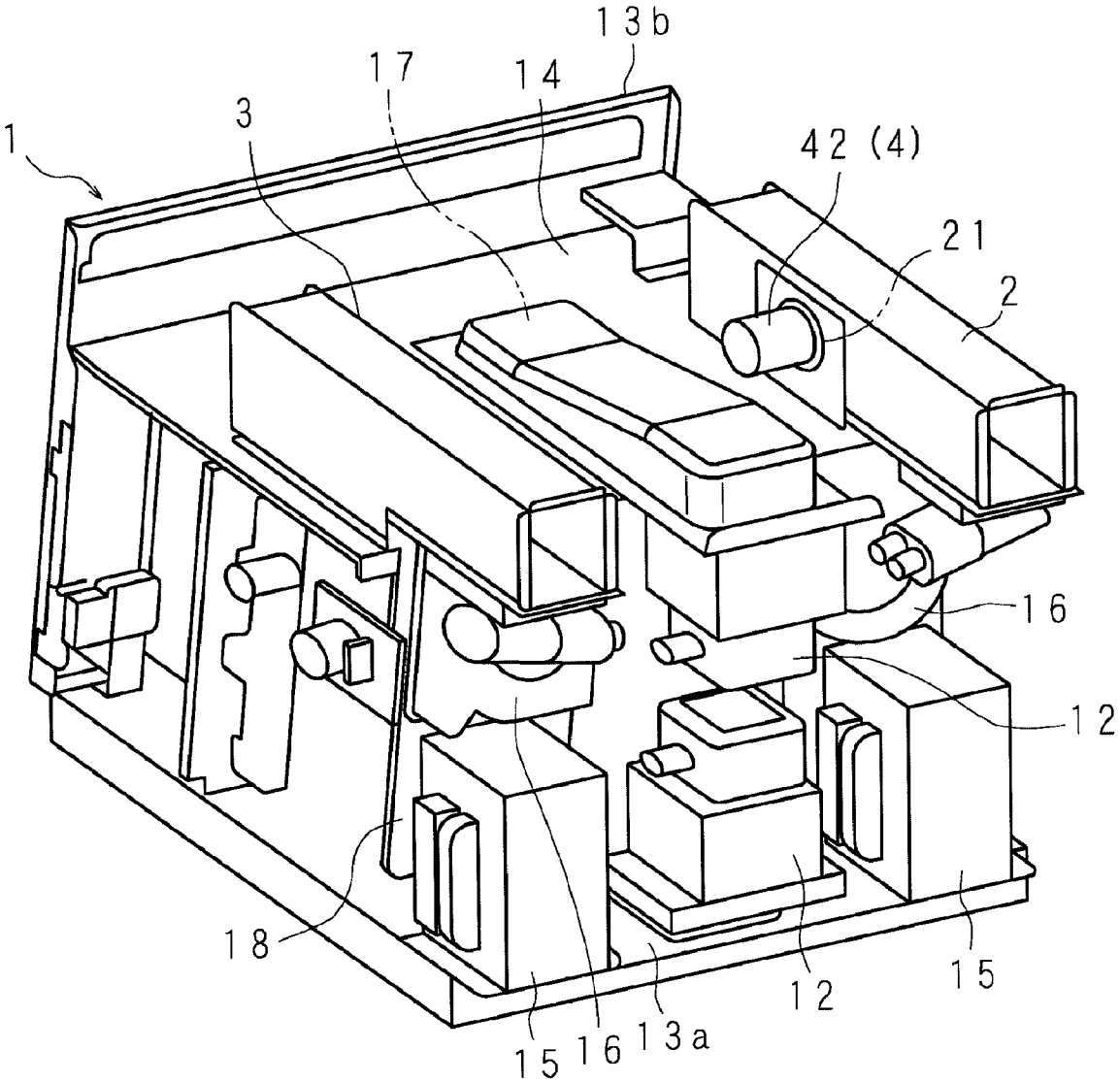
FIG. 3 is a partial rear-side perspective view for showing the structure of a cooking device according to the present invention.
Figure 4:
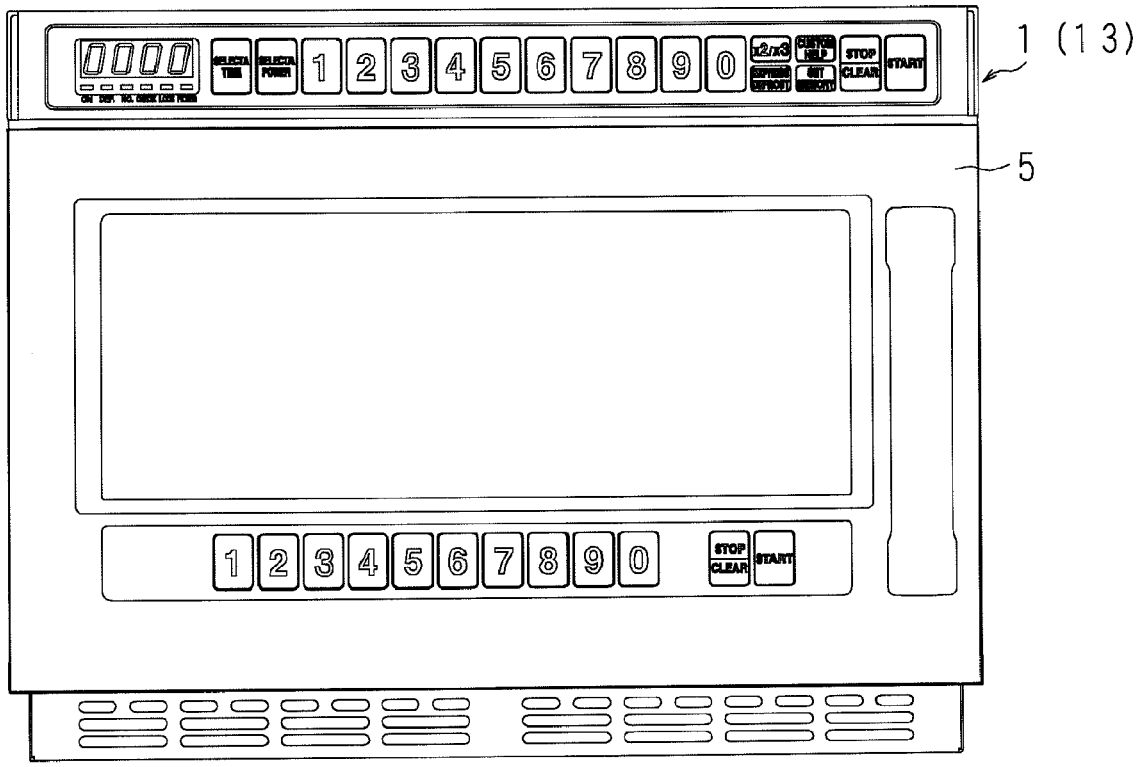
FIG. 4 is a front view for showing the structure of a cooking device according to the present invention.
Figure 5:
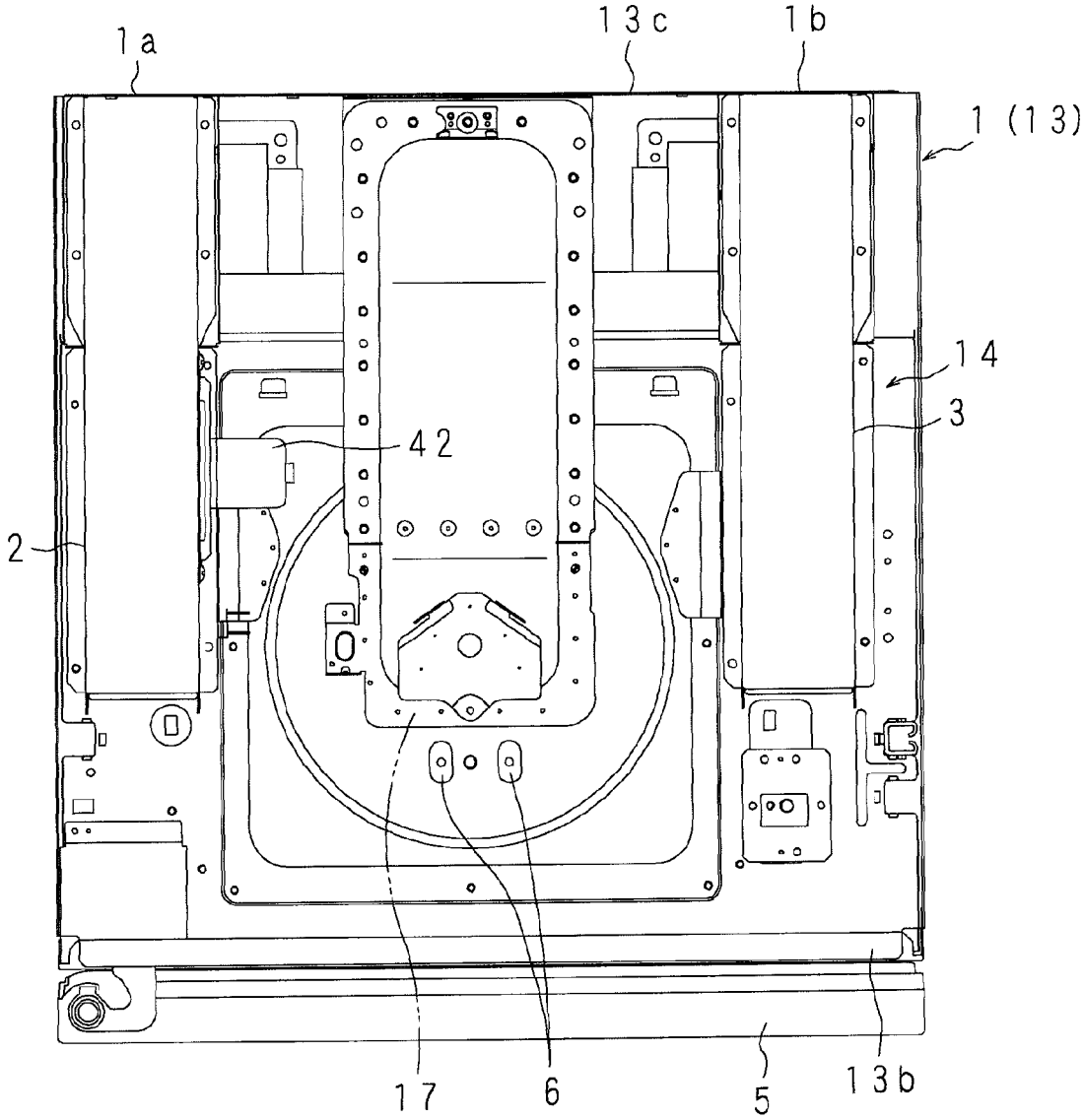
FIG. 5 is a partial plan view for showing the structure of a cooking device according to the present invention.
Figure 6:
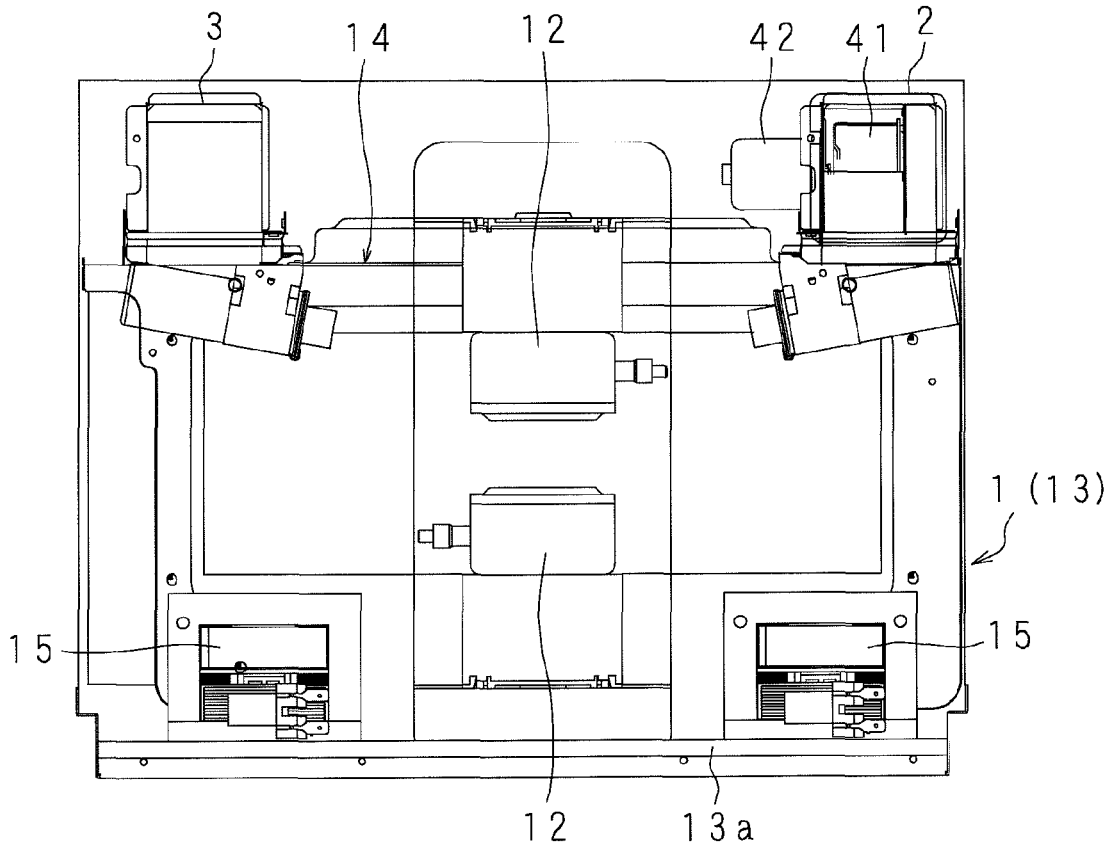
FIG. 6 is a partial rear view for showing the structure of a cooking device according to the present invention.
Figure 7:
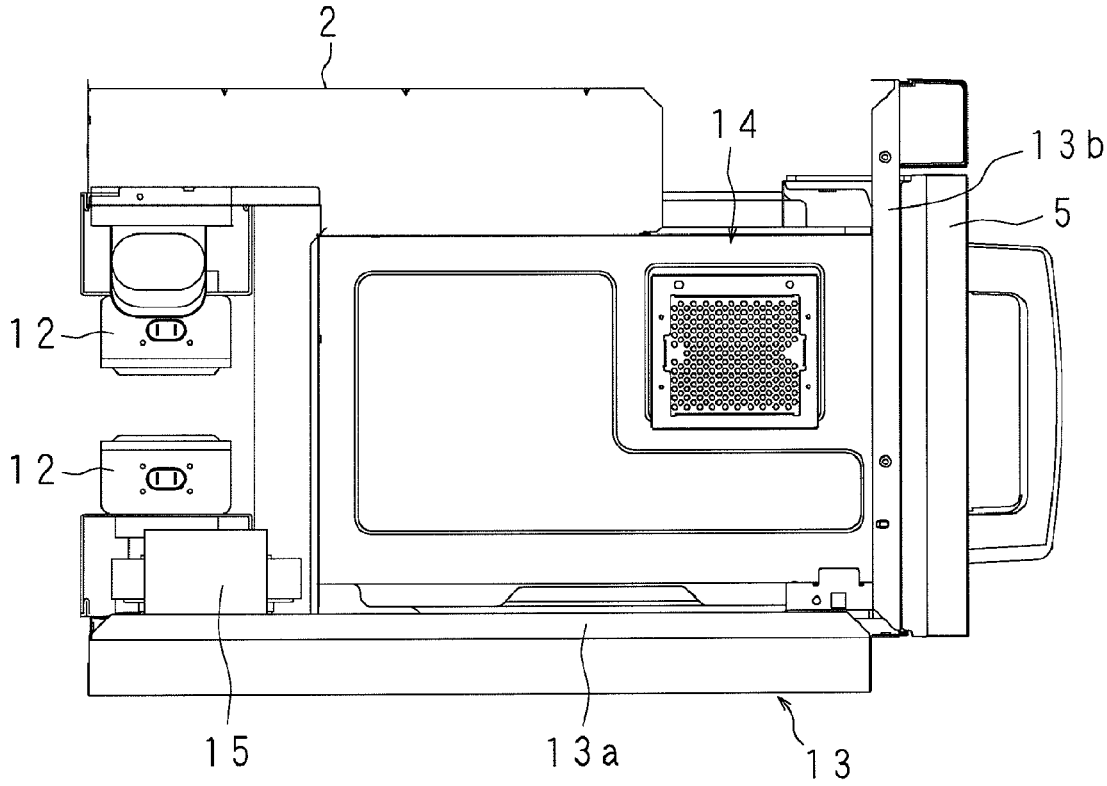
FIG. 7 is a partial left side view for showing the structure of a cooking device according to the present invention.
Figure 8:
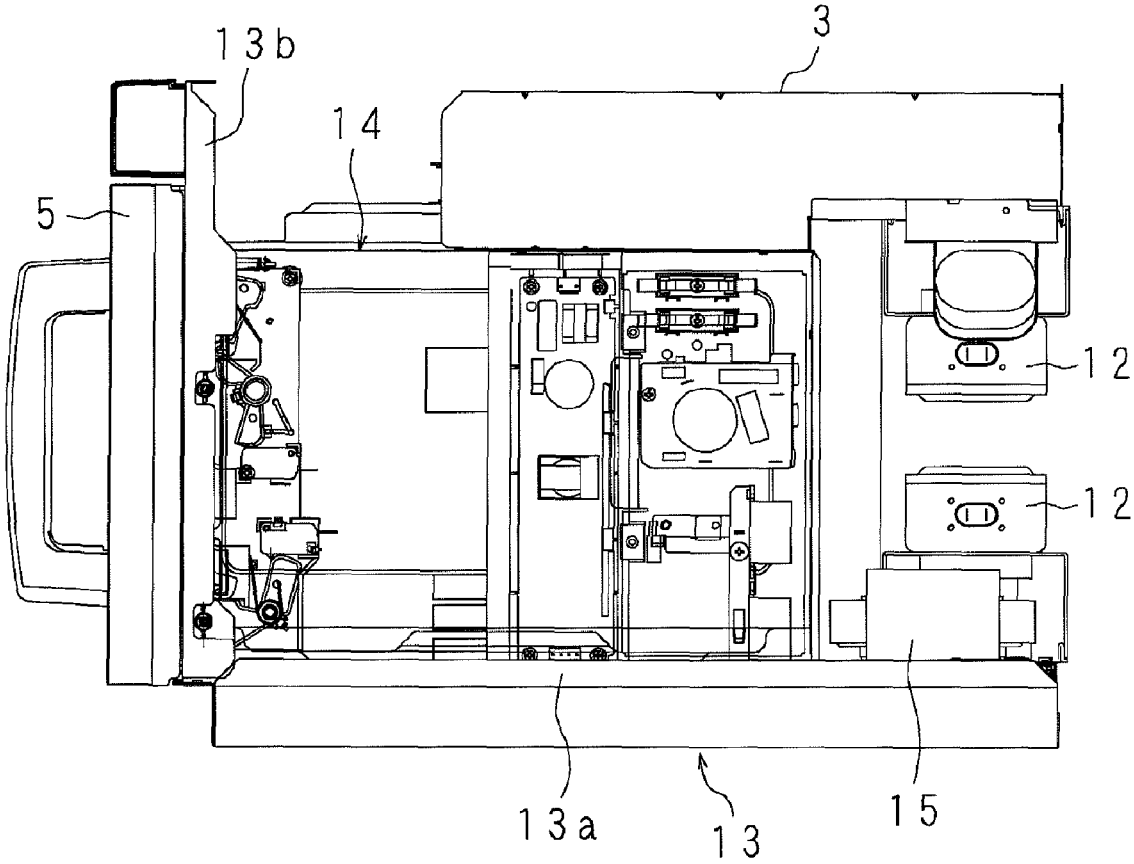
FIG. 8 is a partial right side view for showing the structure of a cooking device according to the present invention.
Figure 9:
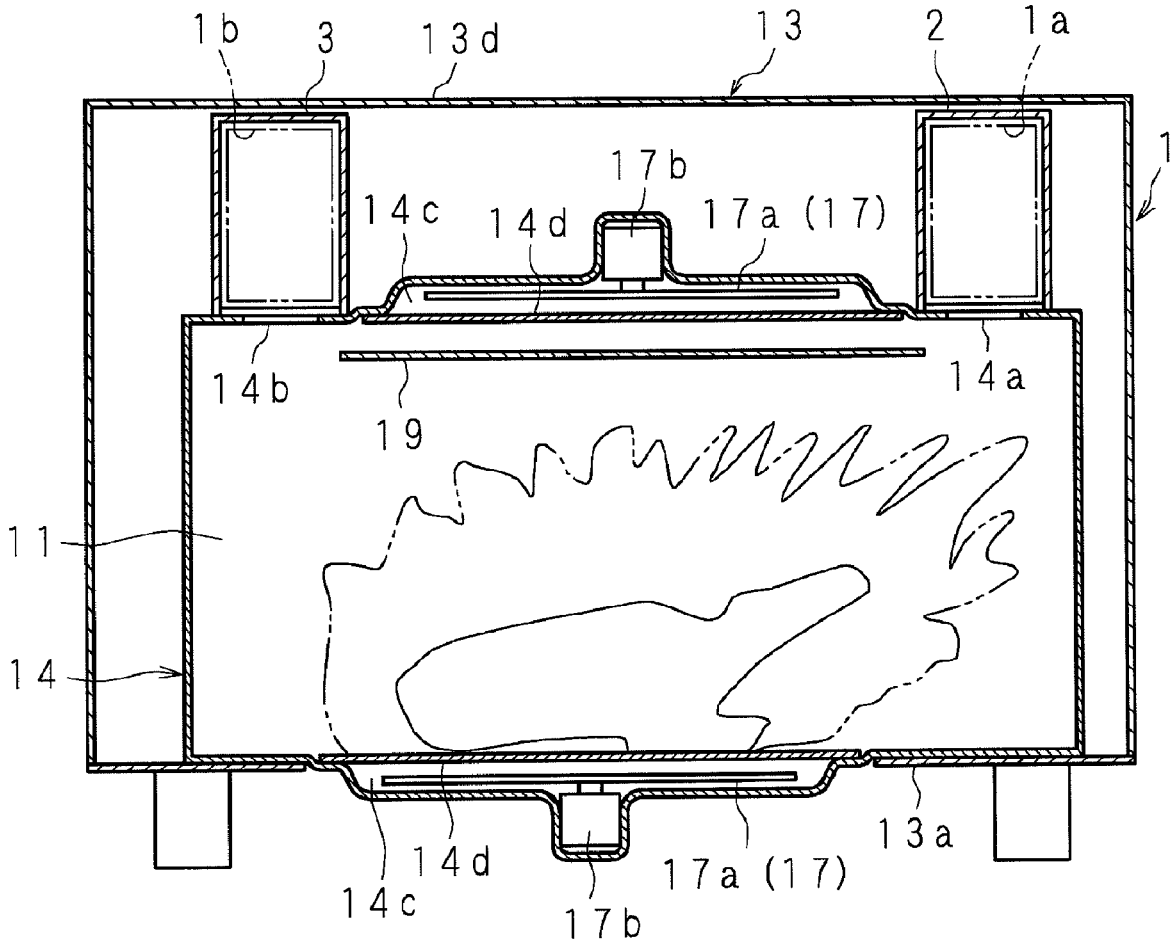
FIG. 9 is a schematic sectional view for showing the structure of a cooking device according to the present invention.
Figure 10:
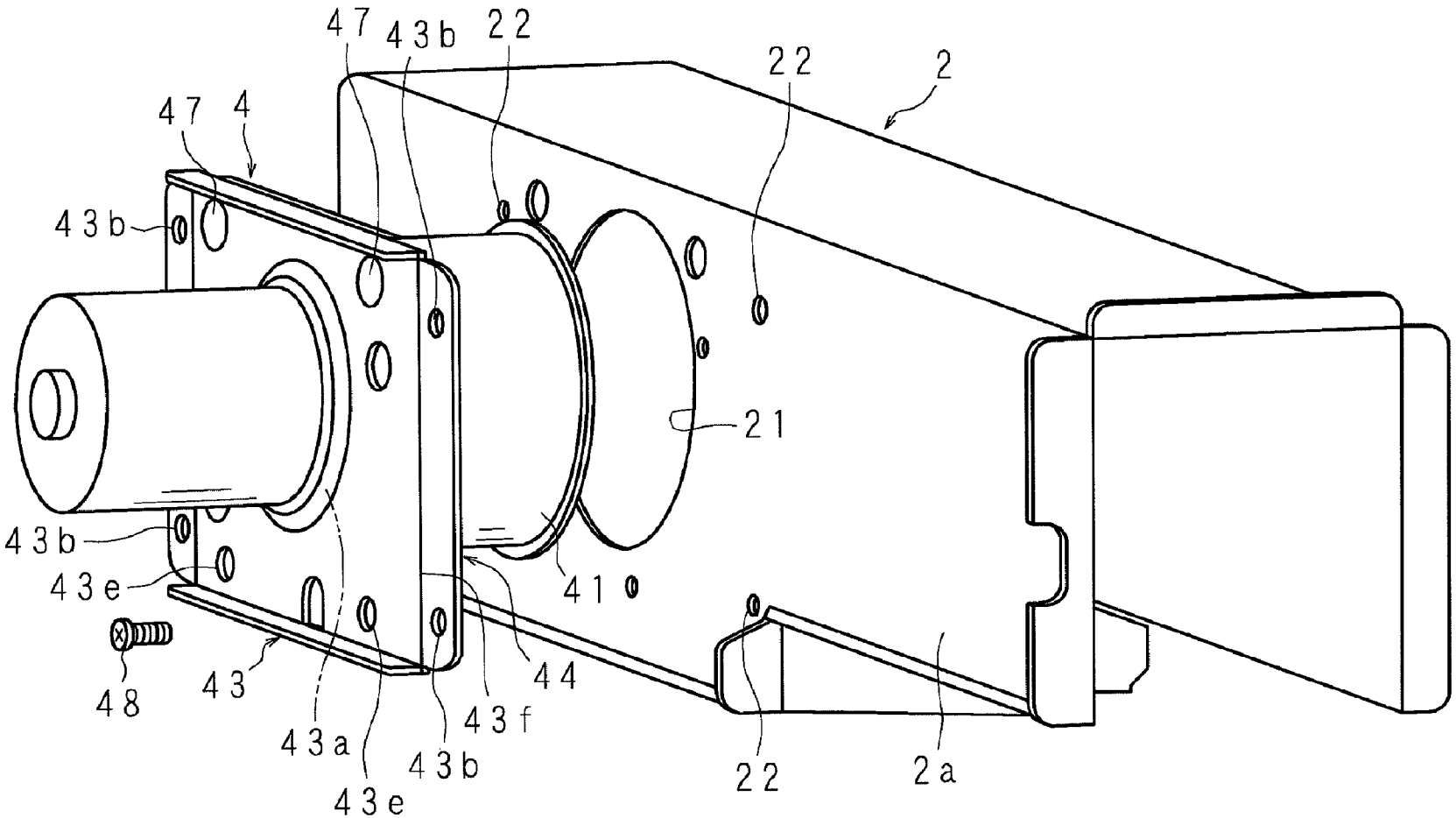
FIG. 10 is an exploded perspective view for showing the relation between an exhaust duct and a fan in a cooking device according to the present invention.
Figure 11:
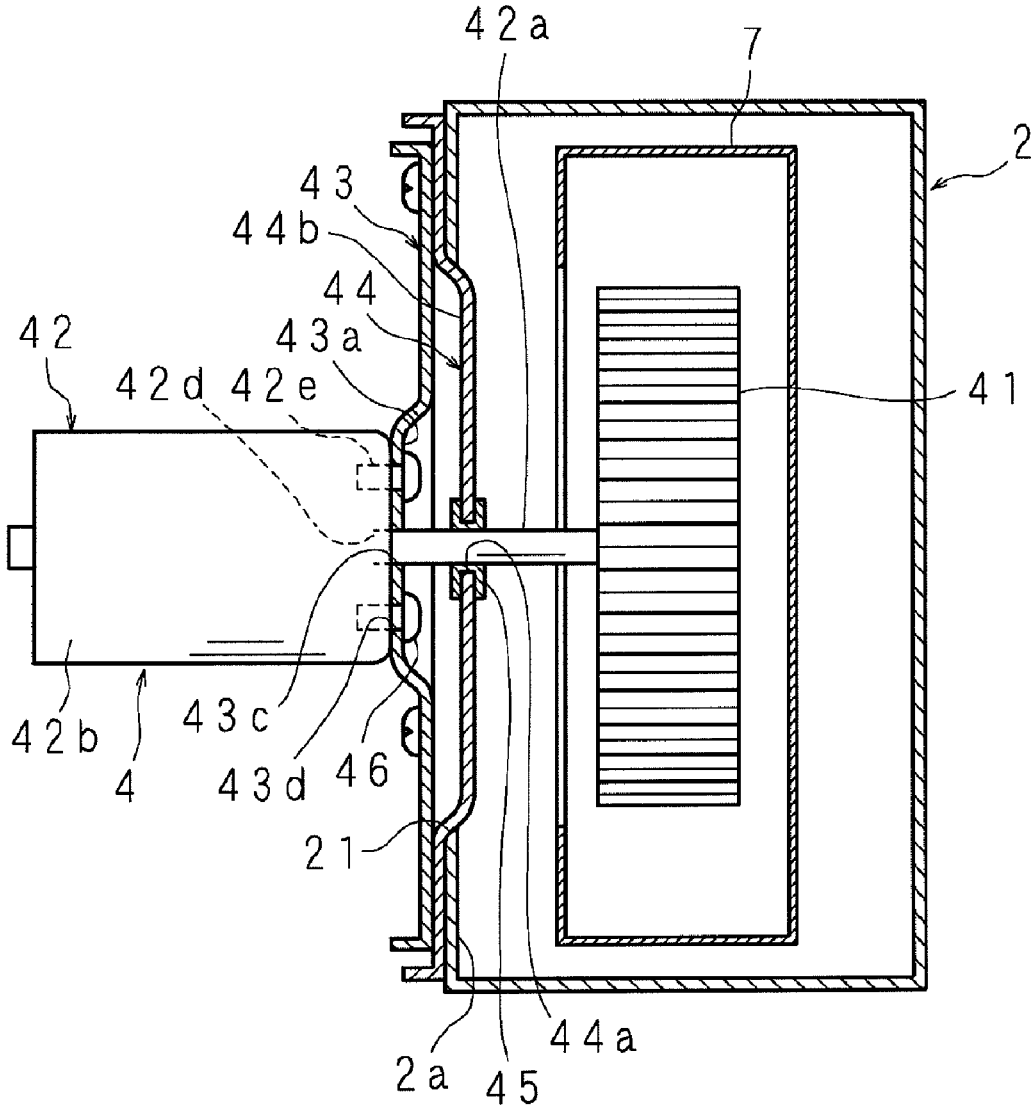
FIG. 11 is an enlarged sectional view of the part of an exhaust duct and a fan in a cooking device according to the present invention.

FIG. 1 is a schematic perspective view for showing the structure of a cooking device according to the present invention; FIGS. 2 and 3 are partial rear-side perspective views for showing the structure of a cooking device; FIG. 4 is a front view for showing the structure of a cooking device; FIG. 5 is a partial plan view for showing the structure of a cooking device; FIG. 6 is a partial rear view for showing the structure of a cooking device; FIG. 7 is a partial left side view for showing the structure of a cooking device; FIG. 8 is a partial right side view for showing the structure of a cooking device; FIG. 9 is a schematic sectional view for showing the structure of a cooking device; FIG. 10 is an exploded perspective view for showing the relation between an exhaust duct and a fan; and FIG. 11 is an enlarged sectional view of the part of an exhaust duct and a fan.

A cooking device shown in FIG. 1 is a microwave oven for heating an object with electromagnetic wave, and comprises: a cooking device body 1 in a substantially rectangular parallelepiped shape, having a heating chamber 11 for heating an object at the front side and electromagnetic generating means 12 behind said heating chamber 11; an exhaust duct 2, which is disposed at one side above the heating chamber 11, for guiding air in the heating chamber 11 to the outside of the cooking device body 1; an air supply duct 3, which is disposed at the other side above the heating chamber 11, for supplying external air to the heating chamber 11; and a fan 4 for discharging air in the heating chamber 11 into the exhaust duct 2.

The cooking device body 1 has a substantially rectangular parallelepiped shape and comprises: a cabinet 13 which is open in front of the heating chamber 11; a door member 5 for opening and closing an open section at the front side; a housing 14, which is disposed at the front side in the cabinet 13 and has the heating chamber 11; two electromagnetic generating means 12 and 12 disposed behind the housing 14; two transformers 15 and 15 and two cooling fans 16 and 16; electromagnetic supplying means 17 and 17, which are disposed above and under the housing 14, for supplying electromagnetic wave generated by the electromagnetic generating means 12 and 12 to the heating chamber 11; control means for controlling electrical components such as the electromagnetic generating means 12; an operation section for operating the control means; and the like.

The cabinet 13 comprises: a base 13*a* having a quadrangular shape; a front frame 13*b*, which is connected with a front edge section of said base 13*a* and has an open section; a rear frame 13*c* attached to a rear edge section of the base 13*a*; and a covering member 13*d*, which is provided with both lateral plates and a top plate and has a substantially inverted U-shaped shape. The housing 14 is attached to the front side of the base 13*a* and a door member is supported rotatably at one side of the open section of the front frame 13*b*.

A support plate 18 is attached to the rear side of the base 13*a*, and the electromagnetic generating means 12, the transformers 15 and the cooling fans 16 are respectively attached to the support plate 18 and the base 13*a*. Each electromagnetic generating means 12 is constituted of a magnetron. Moreover, each electromagnetic supplying means 17 comprises a rotating antenna 17*a* having a radial convex and a motor 17*b* for driving said rotating antenna 17*a*.

An exhaust port 1*a* having a grille-like shape is provided at one side of an upper section of the rear frame 13*c* to communicate with an outlet side end of the exhaust duct 2, and an intake port 1*b* having a grille-like shape is provided at the other side of an upper section of the rear frame 13*c* to communicate with an inlet side end of the air supply duct 3.

The housing 14 has a substantially rectangular parallelepiped shape having an open section at the front side, and an outlet port 14*a* (first port) is provided at one lateral section of a top wall and an inlet port 14*b* (second port) is provided at the other lateral section as shown in FIG. 9. The outlet port 14*a* and the inlet port 14*b* are composed of a plurality of small pores. Moreover, a circular recess 14*c* is provided at a central section of each of the top wall and the bottom wall, the electromagnetic supplying means 17 are respectively disposed at the recesses 14*c*, and sensors 6 are provided for detecting driving/suspension of the rotating antennas 17*a* and cover plates 14*d* for closing openings of the recesses 14*c*. Moreover, a shield plate 19 is provided above the heating chamber 11, separated downwards from a top wall including the cover plate 14*d* so as to form a vent path between the shield plate 19 and said top wall.

The exhaust duct 2 and the air supply duct 3 are formed to have the same rectangular cylindrical shape provided with both lateral plates, a top plate, a bottom plate and one end plate, an inlet corresponding to the outlet port 14*a* is provided at the bottom plate of the exhaust duct 2, and an outlet corresponding to the inlet port 14*b* is provided at the bottom plate of the air supply duct 3. The inside of the exhaust duct 2 forms an exhaust guide path for guiding air blown off from the fan 4 to the exhaust port 1*a*, and the inside of the air supply duct 3 forms an air supply guide path for guiding external air sucked from the intake port 1*b* to the inlet port 14*b*.

The exhaust duct 2 and the air supply duct 3 are disposed backward and forward at both lateral sides of the top wall of the housing 14, and lower edge sections of both lateral plates are attached to the top wall. Moreover, an end plate of the exhaust duct 2 is disposed at the outlet port 14*a* side and an end plate of the air supply duct 3 is disposed at the inlet port 14*b* side.

After the exhaust duct 2 is formed to have the same shape as that of the air supply duct 3, a circular opening 21 which penetrates in a direction intersecting the air guiding direction of the exhaust guide path and a plurality of threaded holes 22 are provided at one lateral plate 2*a* at the inlet side. The opening 21 is formed to have a diameter larger than that of a bladed wheel 41 in the fan 4. Moreover, a casing 7 for housing the bladed wheel 41 is provided inside the exhaust duct 2 at the inlet side.

The casing 7 has an arc-shaped guide plane for guiding air current generated by rotation of the bladed wheel 41 to the rotation direction of the bladed wheel 41 and an outlet port which is open from a part of the arc-shaped guide plane to one tangential direction of the arc-shaped guide plane, and the center of the bladed wheel 41 is disposed at an eccentric position decentered to the outlet port side with respect to the center of the arc-shaped guide plane, so that the bladed wheel 41 rotates in a direction opposite to a direction in which the outlet port is provided. The outlet port has a rectangular cylindrical shape and is disposed with one face in an extension to the arc-shaped guide plane being parallel to the exhaust guide path at the top plate.

Figure 12:
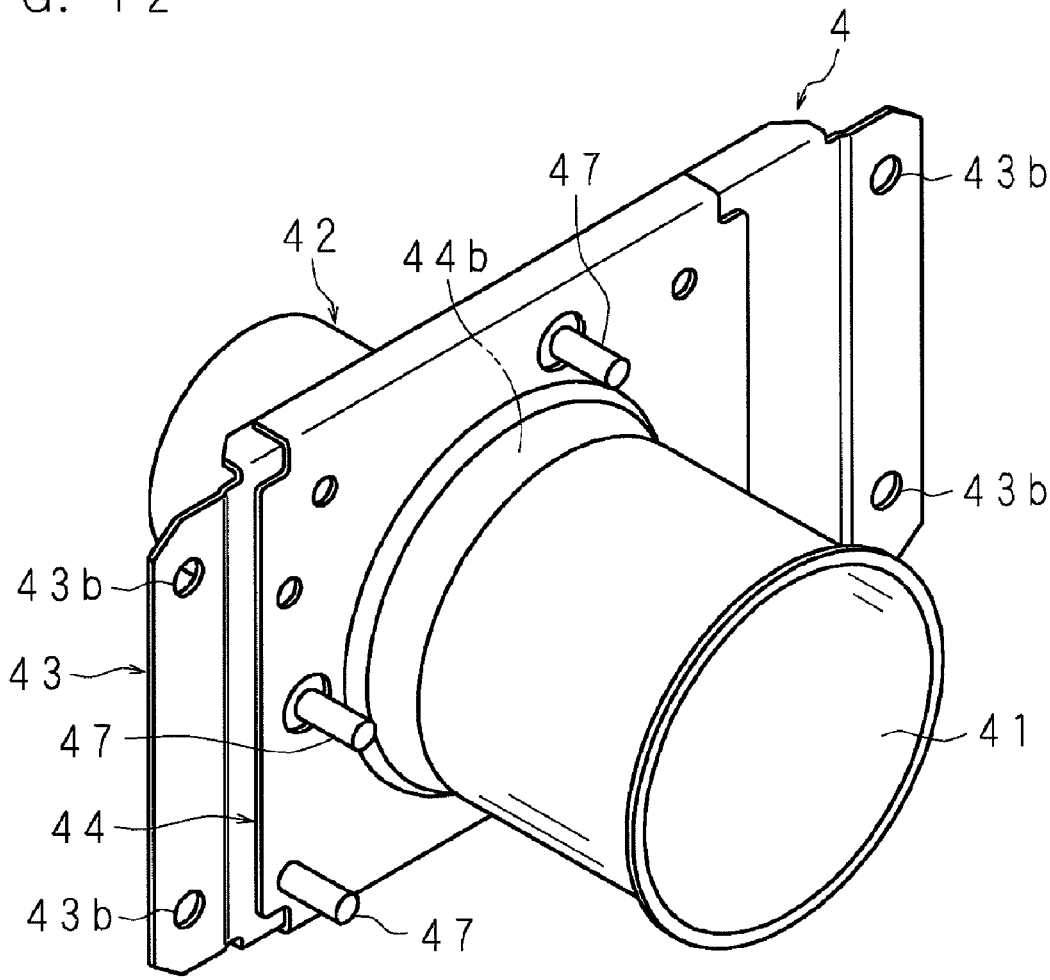
FIG. 12 is a perspective view for showing the structure of a fan in a cooking device according to the present invention.
Figure 13:
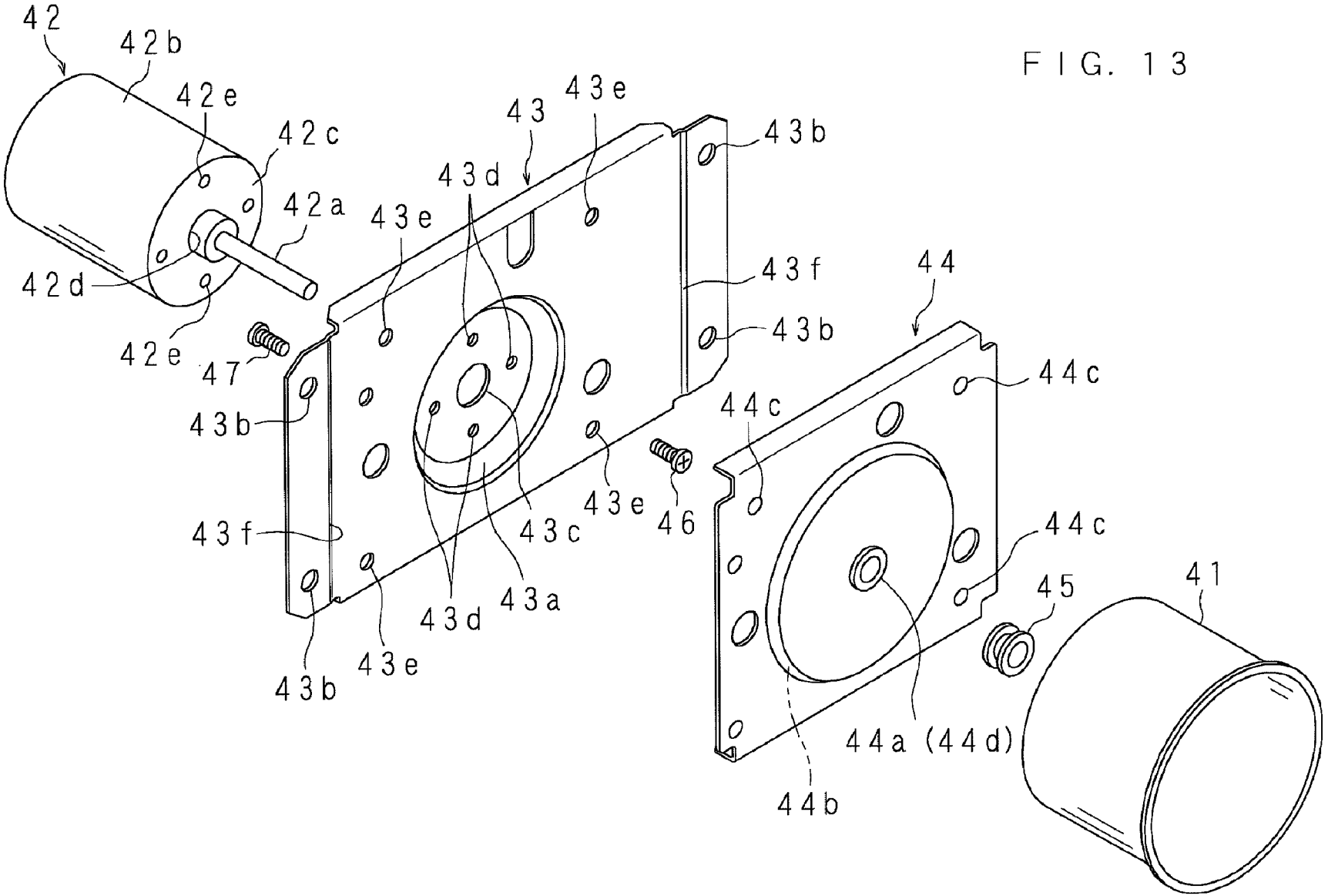
FIG. 13 is an exploded perspective view for showing the structure of a fan in a cooking device according to the present invention.
Figure 14:
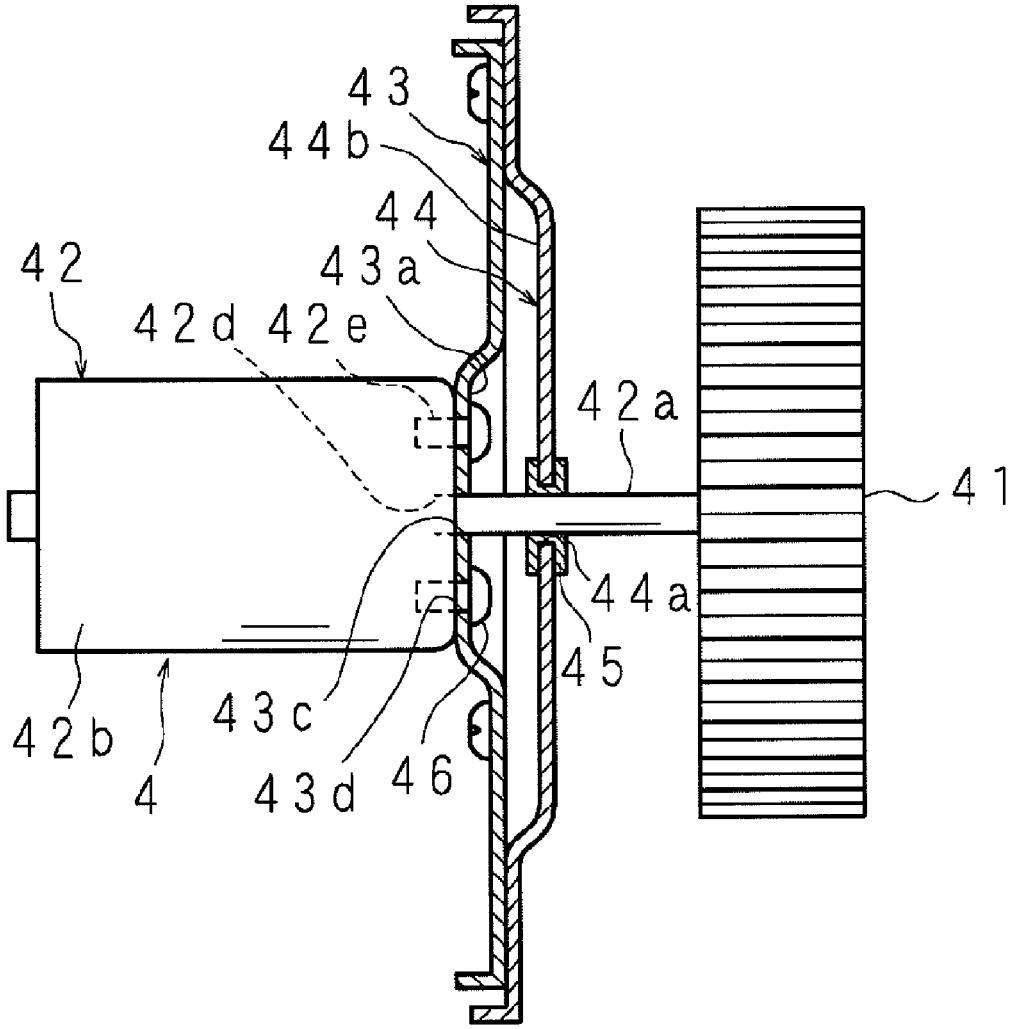
FIG. 14 is an enlarged sectional view for showing the structure of a fan in a cooking device according to the present invention.

FIG. 12 is a perspective view for showing the structure of the fan 4; FIG. 13 is an exploded perspective view for showing the structure of the fan 4; and FIG. 14 is an enlarged sectional view for showing the structure of the fan 4.

The fan 4 comprises: a motor 42 disposed outside the exhaust duct 2; the bladed wheel 41 which is attached to an output shaft 42*a* of said motor 42 and disposed rotatably in the casing 7; a mounting plate 43 (first plate) having a central section attached to the motor 42 and an outer edge section attached to the periphery of the opening 21; and a shield plate 44 (second plate) having a shaft hole 44*a*, into which the output shaft 42*a* is to be inserted, formed at a central section and an outer edge section attached to a bladed wheel 41 side of the mounting plate 43.

The motor 42 is provided with a stator and a rotator in a case 42*b* having a cover plate section at both ends of a cylindrical section, and the output shaft 42*a* connected with a central section of said rotator is extended outwards from one cover plate section 42*c* of the case 42*b*. Moreover, the one cover plate section 42*c* is provided with a shaft hole 42*d* into which the output shaft 42*a* is inserted and a plurality of threaded holes 42*e*.

The bladed wheel 41 is a multiblade bladed wheel having a plurality of blades having the rotation center side to be displaced forward in the rotation direction with respect to an outer edge, that is to say, a cylindrical Sirocco bladed wheel wherein a bearing plate is provided at one end and the output shaft 42*a* is attached to a shaft hole provided at the center of said bearing plate, so that air sucked from the other opening into a cavity at a central section is released from between blades at a peripheral section. It should be noted that a bushing is fitted into the shaft hole and the output shaft 42*a* is inserted and fitted into said bushing.

The mounting plate 43 is formed to have a quadrangular shape provided with a circular recess 43*a*, which has a size corresponding to the outer diameter of the case 42*b*, at a central section and insertion holes 43*b* corresponding to the threaded holes 22 at outer edge sections, and is made by pressing an iron plate into shapes. The recess 43*a* is depressed to the motor 42 side, and a shaft hole 43*c* into which the output shaft 42*a* is to be inserted and mounting holes 43*d* corresponding to the threaded holes 42*e* are provided at the recess 43*a*. Moreover, a plurality of insertion holes 43*e* are provided between the recess 43*a* and the insertion holes 43*b*, and the outer edge sections of the mounting plate 43 where the insertion holes 43*b* are provided are displaced to the bladed wheel 41 side by step sections 43*f*.

The shield plate 44 is formed to have a quadrangular shape provided with a circular recess 44*b*, which has a size corresponding to the outer diameter of the bladed wheel 41 and the opening 21, at a central section and threaded holes 44*c* corresponding to the insertion holes 43*e* at an outer edge section, and is made by pressing a stainless plate into shapes. The recess 44*b* is depressed to the bladed wheel 41 side, and a cavity having a sealed structure is provided at the periphery of the output shaft 42*a* between said recess 44*b* and the recess 43*a*. A shaft hole 44*a* into which the output shaft 42*a* is to be inserted is provided at the recess 44*b*. A cylindrical boss 44*d* is integrally provided at the shaft hole 44*a*, a flanged sealing tube 45 is fitted into said cylindrical boss 44*d*, and the output shaft 42*a* is inserted into said sealing tube 45. Moreover, the recess 44*b* of the shield plate 44 is formed to have a diameter larger than that of the recess 43*a* of the mounting plate 43.

The fan 4 of a cooking device having the above structure is assembled in the following processes.

(1) The output shaft 42*a* of the motor 42 is inserted into the shaft hole 43*c* of the mounting plate 43, the outer face of the recess 43*a* at the mounting plate 43 is made in contact with the cover plate section 42*c*, and external threads 46 inserted into the mounting holes 43*d* are screwed into the threaded holes 42*e*, so that the mounting plate 43 is attached to the motor 42. In this process, the head of each external thread 46 is disposed at the recess 43*a*.

(2) The output shaft 42*a* is inserted into the shaft hole 44*a* of the shield plate 44, the shield plate 44 is made in contact with the periphery of the recess 43*a* at the mounting plate 43, and external threads 47 inserted into the insertion holes 43*e* are screwed into the threaded holes 44*c*, so that the shield plate 44 is connected with the mounting plate 43. In this process, the recesses 43*a* and 44*b* face each other and a cavity having a sealed structure is formed at the periphery of the output shaft 42*a* between the recesses 43*a* and 44*b*.

(3) An end section of the output shaft 42*a* is fitted into the bushing of the bladed wheel 41 and the bushing is fixed at the output shaft 42*a* with external threads, which are not illustrated, that is to say, the bladed wheel 41 is fixed at the output shaft 42*a*.

Thus, the fan 4 having the motor 42, the mounting plate 43, the bladed wheel 41 and the shield plate 44 is formed.

The fan 4 assembled as described above can be attached to the exhaust duct 2 by inserting the bladed wheel 41 from the outside of the lateral plate 2*a* at the exhaust duct 2 through the opening 21 into the casing 7 in the exhaust duct 2, making the mounting plate 43 in contact with the outer face of the lateral plate 2*a* at the exhaust duct 2, screwing external threads 48 inserted into the insertion holes 43*b* into the threaded holes 22, and fixing the mounting plate 43 at the lateral plate 2*a*. Since the bladed wheel 41 can be attached to the output shaft 42*a* of the motor 42 outside the exhaust duct 2 as described above, it is possible to fix the bladed wheel 41 reliably and to easily and reliably check the fixation state and the dynamic balance of the bladed wheel visually, aurally and tactually.

Moreover, for cleaning or replacing the fan 4, the bladed wheel 41 can be pulled from the inside of the casing 7 through the opening 21 to the outside of the exhaust duct 2 by screwing down the external threads 48 so as to unlock the mounting plate 43, and the fan 4 can be detached from the exhaust duct 2. Since the fan 4 can be detached by screwing down the external threads 48 which are to fix the mounting plate 43 as described above, it is possible to achieve cleaning of the fan 4 or replacement of the motor 42 or the like easily, and therefore it is possible to facilitate replacement and maintenance of the cooking device and to shorten shutdown time (down time) of a cooking device for business use, which may reduce profits.

Regarding a cooking device for business use, at time required for maintenance, the number of available cooking devices decreases and waiting time for customers lengthens during busy times, causing a problem that customer satisfaction lowers especially in the field of fast-food. Accordingly, the effect of shortening of shutdown time (down time) of a cooking device for business use does not only contribute directly to profits with an increase in operating time but also enhances customer satisfaction and market valuation.

Moreover, in a cooking device having the above structure, the control means is made to work by operating the operation section, power is distributed to a magnetron which functions as the electromagnetic generating means 12, electromagnetic wave is supplied from the electromagnetic supplying means 17, which are disposed above and under the heating chamber 11, to the heating chamber 11, an object housed in the heating chamber 11 is cooked, and the fan 4 and the cooling fans 16 are driven. The inside of the heating chamber 11 reaches a relatively high temperature during cooking and hot air sometimes up to and rarely exceeding the boiling point and steam are generated.

By driving the fan 4, air in the heating chamber 11 including hot air and steam is sucked from the outlet port 14*a* of the housing 14 into the casing 7, the internal pressure of the heating chamber 11 lowers, external air is sucked from the intake port 1*b* into the air supply duct 3, and air is distributed through the air supply duct 3 and supplied from the inlet port 14*b* to the heating chamber 11.

The bladed wheel 41 of the fan 4 rotates in a direction opposite to a direction (the one tangential direction) in which the outlet port is provided, air current generated by rotation of the bladed wheel 41 collides with the inner face of the outlet port to be turbulent flow which oscillates upward and downward, and the turbulent flow is blown off into the exhaust duct 2, distributed along the exhaust guide path and discharged from the exhaust port 1*a* to the outside. In this process, hot air and steam having a relatively high temperature are distributed in the casing 7 and the exhaust duct 2, and the opening 21 part of the exhaust duct 2 is also exposed to hot air and steam.

Since the recess 44*b* part of the shield plate 44 is located in the opening 21 of the exhaust duct 2, and the mounting plate 43, the shield plate 44 and a cavity between recesses 43*a* and 44*b* at the mounting plate 43 and the shield plate 44 shield the motor 42 and the inside of the exhaust duct 2, it is possible to prevent conduction of hot air in the exhaust duct 2 to the motor 42, to depress rise in temperature of the motor 42 and to enhance the durability of the motor 42 to hot air. Moreover, since the shaft hole 44*d* of the shield plate 44 is provided with the sealing tube 45, it is possible to prevent steam in the exhaust duct 2 from outflowing from the periphery of the output shaft 42*a* to the motor 42 side and to is enhance the durability of the motor 42 to steam.

It should be noted that, although the embodiment explained above is constructed in such a manner that the motor 42 is attached to the exhaust duct 2 by attaching the mounting plate 43 to the lateral plate 2*a*, another embodiment may be constructed in such a manner that the motor 42 is attached to the exhaust duct 2 via the shield plate 44 and the mounting plate 43 by attaching the shield plate 44, which is to be connected with the mounting plate 43, to the lateral plate 2*a*.

Moreover, although the embodiment explained above is constructed in such a manner that the shaft hole 44*a* of the shield plate 44 is provided with the sealing tube 45, another embodiment may be constructed in such a manner that the sealing tube 45 is eliminated and a clearance between the shaft hole 44*a* and the peripheral face of the output shaft 42*a* is made small. In this case, even when steam in the exhaust duct 2 flows into the shaft hole 44*a* of the shield plate 44, a cavity between the shield plate 44 and the mounting plate 43 can depress flow into the shaft hole 43*c* of the mounting plate 43. Moreover, since steam which has flown into the shaft hole 44*a* of the shield plate 44 flows downwards to the bottom section of the cavity, it is possible to prevent steam in the exhaust duct 2 from outflowing from the periphery of the output shaft to the motor 42 side and to enhance the durability of the motor 42 to steam.

Moreover, although the embodiment explained above is constructed in such a manner that the mounting plate 43 and the shield plate 44 have the recesses 43*a* and 44*b* and the recesses 43*a* and 44*b* together define a cavity, another embodiment may be constructed in such a manner that one of the recesses 43*a* and 44*b* is eliminated and the other recess 43*a* or 44*b* forms a cavity.

Moreover, although the embodiment explained above is constructed in such a manner that the exhaust duct 2 and the air supply duct 3 are located above the heating chamber 11, at least one of the exhaust duct 2 and the air supply duct 3 may be located lateral to the heating chamber 11.

Moreover, although a centrifugal fan 4 having a multiblade bladed wheel 41 is used in the embodiment explained above, a centrifugal fan having a radial bladed wheel or a turbo bladed wheel may be used as the fan 4, or an axial fan may be used.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A cooking device comprising:

a cooking device body having a heating chamber for heating an object;

an exhaust duct communicating with a first port provided at a wall of the heating chamber and with outside of the cooking device body; and a fan for discharging air in the heating chamber, wherein said fan sucks air from the first port and air blown off from said fan is guided through the exhaust duct and exhausted out from the cooking device body, the exhaust duct has an opening at a wall in a direction intersecting a guiding direction, the fan includes a motor disposed outside the exhaust duct, a bladed wheel which is attached to an output shaft of said motor and disposed in the exhaust duct, a first plate, which is located between the motor and the bladed wheel, having a shaft hole into which the output shaft is inserted, and a second plate, which is located between said first plate and the bladed wheel, having a shaft hole into which the output shaft is inserted, a sealing tube is fitted into the shaft hole of the second pate, and the output shaft is inserted into the shaft hole of the second plate via the sealing tube, and the opening of the exhaust duct is covered with one or both of the first plate and the second plate when the fan is attached to the exhaust duct.

2. The cooking device according to claim 1, wherein a periphery of the shaft hole of the first plate is attached to the motor, an outer edge section of the second plate is attached to a bladed wheel side of the first plate.

3. The cooking device according to claim 2, wherein the bladed wheel is formed so as to be inserted from outside of the exhaust duct into the opening and the second plate has a recess depressed towards a bladed wheel side.

4. The cooking device according to claim 3, wherein a shaft hole section of the first plate has a recess depressed towards a motor side.

5. The cooking device according to claim 3, wherein a boss is integrally provided at the shaft hole of the second plate.

6. The cooking device according to claim 1, further comprising an air supply duct communicating with a second port provided at a wall of the heating chamber and with outside of the cooking device body.

* * * * *